US011403928B2

(12) United States Patent
Miettinen et al.

(10) Patent No.: US 11,403,928 B2
(45) Date of Patent: Aug. 2, 2022

(54) SYSTEM, METHOD AND APPARATUSES FOR ELECTRONIC ARTICLE SURVEILLANCE

(71) Applicant: NOCCELA OY, Turku (FI)

(72) Inventors: Riku Tapio Miettinen, Turku (FI); Heikki Tapani Talvitie, Littoinen (FI)

(73) Assignee: NOCCELA OY, Turku (FI)

( * ) Notice: Subject to any disclaimer, the term of this patent is extended or adjusted under 35 U.S.C. 154(b) by 0 days.

(21) Appl. No.: 15/571,560

(22) PCT Filed: May 4, 2016

(86) PCT No.: PCT/FI2016/050290
§ 371 (c)(1),
(2) Date: Nov. 3, 2017

(87) PCT Pub. No.: WO2016/177939
PCT Pub. Date: Nov. 10, 2016

(65) Prior Publication Data

US 2019/0130714 A1 May 2, 2019

(30) Foreign Application Priority Data

May 4, 2015 (GB) ..... 1507628
Feb. 9, 2016 (FI) ..... 20165090

(51) Int. Cl.
*G08B 13/24* (2006.01)
*E05B 73/00* (2006.01)
*G08B 13/14* (2006.01)

(52) U.S. Cl.
CPC ..... *G08B 13/2482* (2013.01); *E05B 73/0017* (2013.01); *G08B 13/14* (2013.01);
(Continued)

(58) Field of Classification Search
CPC .... G08B 13/06; G08B 13/14; G08B 13/2402; G08B 13/2445; G08B 13/2448;
(Continued)

(56) References Cited

U.S. PATENT DOCUMENTS 5,793,290 A 8/1998 Eagleson et al.
2002/0171550 A1 11/2002 Hirose et al.
(Continued)

FOREIGN PATENT DOCUMENTS

WO 0157762 A1 8/2001
WO 02086832 A1 10/2002
(Continued)

OTHER PUBLICATIONS

International Search Report, Appliation No. PCT/FI2016/050290, dated Sep. 8, 2016, 5 pages.
(Continued)

*Primary Examiner* — Brian Wilson
(74) *Attorney, Agent, or Firm* — Ziegler IP Law Group, LLC

(57) ABSTRACT

A method, system and devices of controlling an electronic article surveillance tag in an electronic article surveillance system, the tag including a detector for detecting tampering, the system including a positioning sub-system for determining a position of said tag and a control sub-system for controlling operation of said system. A first status message may be received from the electronic article surveillance tag to the control sub-system over a communications connection at a first time instance, and a first state of the tag may be determined by the control sub-system based on the first status message. The first state may be stored in a memory. A first control message may be sent from the control sub-system to the tag, the control message being formed
(Continued)

based on the first state, and the operation of the tag may be altered based on the first control message.

22 Claims, 6 Drawing Sheets

(52) U.S. Cl.
CPC ..... *G08B 13/248* (2013.01); *G08B 13/2417* (2013.01); *G08B 13/2462* (2013.01)

(58) Field of Classification Search
CPC ..... G08B 13/2451; G08B 13/2462; G08B 13/2465; G08B 13/248; G08B 13/2482; G08B 13/2417; E05B 73/0017; E05B 73/0029
USPC ..... 340/568.1–568.4, 572.1, 572.8, 572.9
See application file for complete search history.

(56) References Cited

U.S. PATENT DOCUMENTS

2004/0113792 A1 6/2004 Ireland et al.
2005/0073406 A1 4/2005 Easley et al.
2005/0231365 A1* 10/2005 Tester ..... G09F 3/0347 292/307 R
2007/0268138 A1 11/2007 Chung et al.
2008/0303670 A1 12/2008 Seidel
2009/0309732 A1 12/2009 Truscott et al.
2010/0141445 A1* 6/2010 Venkatasubramaniyam ..... G06Q 10/08 704/8
2011/0068906 A1 3/2011 Shafer et al.
2011/0074582 A1 3/2011 Alexis
2011/0077909 A1* 3/2011 Gregory ..... G06Q 10/0833 702/187
2011/0080264 A1 4/2011 Clare et al.
2011/0273852 A1 11/2011 Debrody et al.
2011/0316674 A1 12/2011 Joy et al.
2014/0240088 A1 8/2014 Robinette et al.
2015/0130593 A1* 5/2015 Mats ..... G06K 7/10366 340/10.1
2016/0180669 A1* 6/2016 Bradshaw ..... G08B 13/2402 340/572.1
2016/0180671 A1* 6/2016 Hazelwood ..... G08B 13/2462 340/572.1
2016/0180672 A1* 6/2016 Hoehn ..... G08B 13/2462 340/572.1

FOREIGN PATENT DOCUMENTS

WO 2004077686 A2 9/2004
WO 2012123961 A2 9/2012

OTHER PUBLICATIONS

Written Opinion of the International Searching Authority, Application No. PCT/FI2016/050290, dated Sep. 8, 2016, 8 pages.
Written Opinion of the International Preliminary Examining Authority, Application No. PCT/FI2016/050290, dated Jun. 29, 2017, 12 pages.
International Preliminary Report on Patentability, Application No. PCT/FI2016/050290, dated Sep. 6, 2017, 71 pages.

* cited by examiner

SYSTEM, METHOD AND APPARATUSES FOR ELECTRONIC ARTICLE SURVEILLANCE

BACKGROUND

Electronic article surveillance enables the detection and interception of theft attempts of goods on sale at a sales location. For example, an owner of a store selling fashion clothes may find it appropriate to attach electronic article surveillance tags on the garments so that removing a garment from the store will cause an alarm. Often, such alarms are arranged by using gates at the doors of the store. The gates detect the tag being carried through the gate e.g. with the help of a magnetic field. The tags themselves may be difficult to remove from the garment, e.g. so that they contain a locking element for locking a pin of the tag counter-part into place, thus attaching the tag to the garment firmly. The locking is virtually impossible to remove without a release device, usually having a strong magnet.

However, such tags may be removed by having the appropriate instruments. A well-prepared perpetrator may in fact have such technical means, and may attempt theft. To address this, the developers of electronic article surveillance systems have developed ways to detect theft attempts anyway. However, constantly new ways to circumvent such surveillance are developed.

There is, therefore, a need for more reliable and easy-to-use solution for electronic article surveillance.

SUMMARY

Now there has been invented an improved method and technical equipment implementing the method, by which the above problems are alleviated. Various aspects of the invention include a method, a device, a server system, and a computer readable medium comprising a computer program stored therein, which are characterized by what is stated in the independent claims. Various embodiments of the invention are disclosed in the dependent claims.

The invention relates to a method, system and devices of controlling an electronic article surveillance tag in an electronic article surveillance system, the tag comprising a detector for detecting tampering, the system comprising a positioning sub-system for determining a position of said tag and a control sub-system for controlling operation of said system. A first status message may be received from the electronic article surveillance tag to the control sub-system over a communications connection at a first time instance, and a first state of the tag may be determined by the control sub-system based on the first status message. The first state may be stored in a memory. A first control message may be sent from the control sub-system to the tag, the control message being formed based on the first state, and the operation of the tag may be altered based on the first control message.

Two-way communication between a tag and a control sub-system comprises one or more status messages being sent from a tag to the control sub-system, and the control sub-system sending one or more control messages to the tag. The control sub-system may determine the status of the tag and then control the operation (e.g. alarm mode) of the tag based on the determined status. The tag receives the control messages and is able to assume different states of operation and change the state based on a received control message. Such operation makes it easier to manage the system and the tags therein.

DRAWINGS

In the following, various embodiments of the invention will be described in more detail with reference to the appended drawings, in which FIG. 1 shows an electronic article surveillance system and devices according to an embodiment;

Figures 4A, 4B:
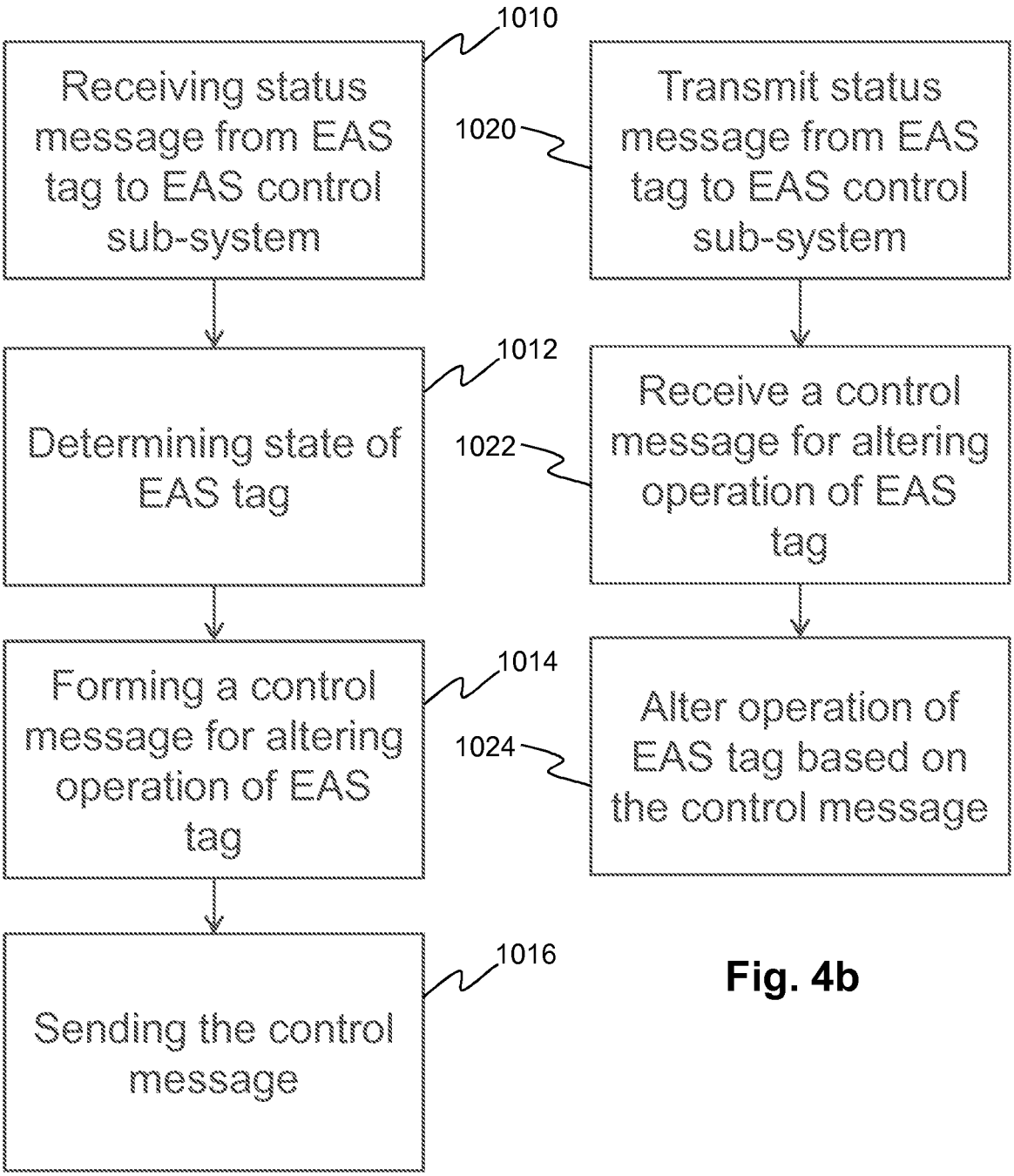
Figure 4C:
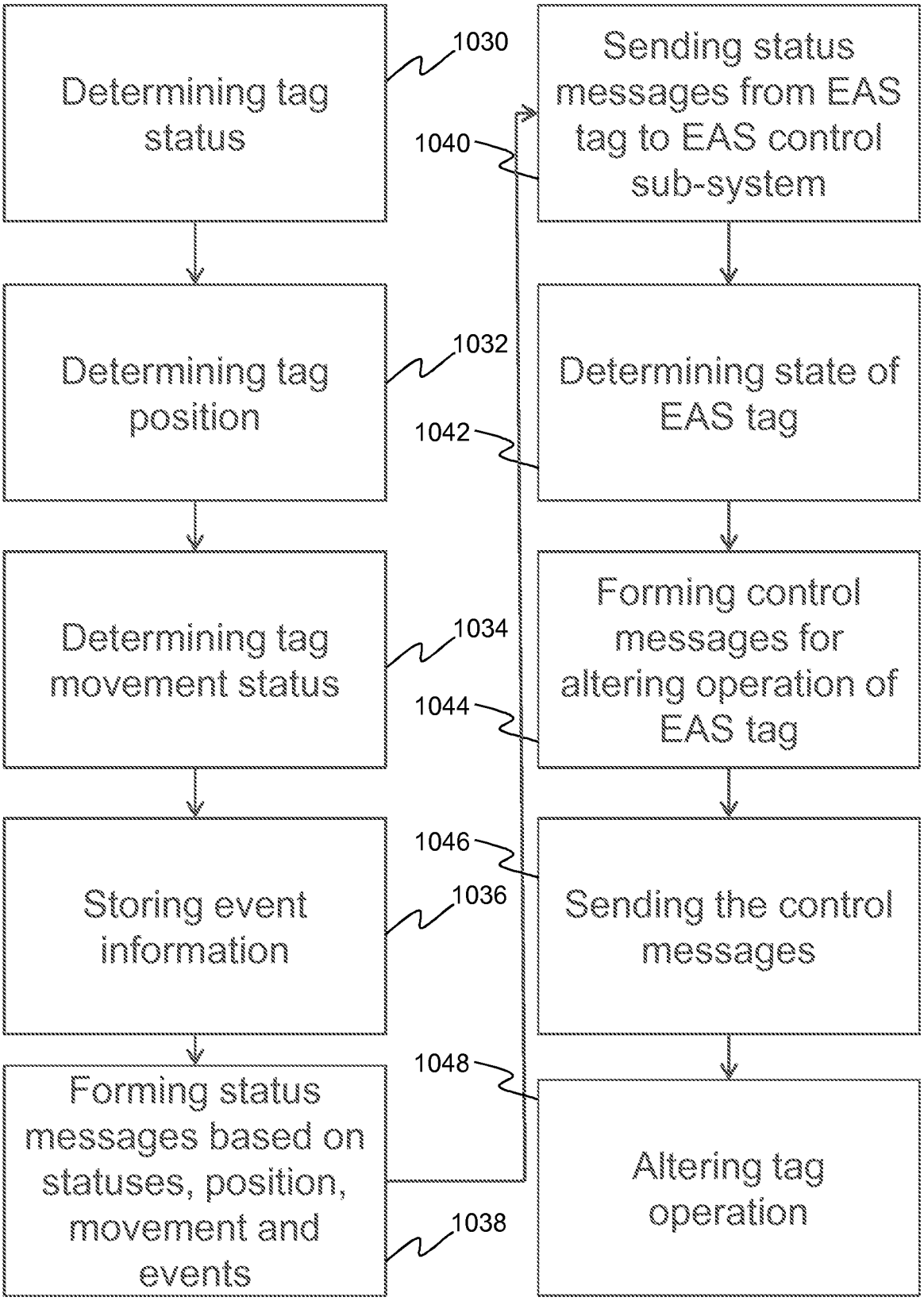
Figure 5A:
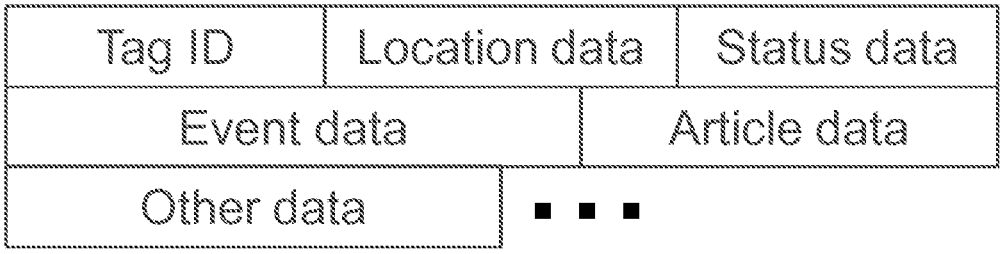
Figure 5B:
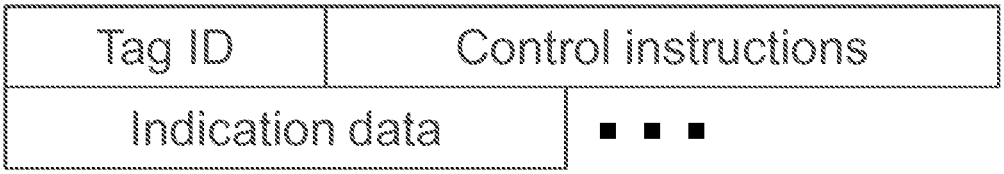

FIGS. 4*a*, 4*b* and 4*c* show flow charts for methods for electronic article surveillance according to an embodiment; and FIGS. 5*a* and 5*b* show message formats for controlling an electronic article surveillance system and tag.

DESCRIPTION

In the following, several embodiments of the invention will be described in the context of certain electronic article surveillance tags and certain system components for positioning and communication. It is to be noted, however, that the invention is not limited to such specific examples. In fact, the different embodiments have applications in any environment where electronic article surveillance, any kind of asset tracking or personnel tracking is required.

Asset tracking may be understood to comprise a system and devices in the system that make it possible to locate an object to which a positioning device has been attached. For example, hospitals and other large facilities may benefit from being able to locate a device or source of supplies quickly and automatically, when the devices or supplies are such that they are constantly used at different places. Personnel tracking may be understood to comprise locating persons with the help of a positioning system. Electronic article surveillance (EAS) may be understood to comprise a system and EAS devices (tags) attached to various articles that are on sale, and the system may enable the detection of unauthorized removal of the EAS devices from the articles. For example, a store selling clothes may attach EAS tags to garments on sale, and the system may be arranged to cause an alarm if a tag is tampered with or removed from the store.

An electronic article surveillance (EAS) system may comprise a plurality of EAS tags, a positioning sub-system and a control sub-system.

The EAS tags are arranged to be attached to sales items e.g. with the help of a pin-based attachment mechanism, and the tags have circuitry and software for sensing the state of the tag and communicating with the control sub-system and/or the positioning sub-system. The EAS tags may comprise one, two or more openings or receptacles for receiving a locking pin, that is, a pin that can be pushed in but whose removal from the locking mechanism requires a special tool. The EAS tags that comprise at least two openings or receptacles for receiving a pin, can also be used with a lanyard having two free ends that are pushed to the openings or receptacles and thus the lanyard is locked into the tag. The tags may have one or more elements for detecting one or more different kinds of tampering attempts. For example, a cutting of a lanyard may be detected electrically, a forced removal of a locking pin may be detected mechanically and/or electrically, and the use of a magnetic tool to remove the pin or lanyard may be detected with a magnetic field detector. The one or more detectors may reside inside the tag, and they may reside on a control circuit board or connected to that.

The positioning sub-system may function so that there are positioning signal transmitters and/or receivers with a known location in the store. The tags may send a signal and after that the position of the tag is estimated from the time difference of arrival to different receivers. Alternatively or in addition tag and position signal transmitter/receiver may also exchange several signals to estimate distance between tag and a transmitter/receiver. Alternatively or in addition, the tags may receive the transmitted signal from the transmitters and are able to transmit the signal information or the computed location. Alternatively or in addition, the tags may be transmitting a signal that is picked up by positioning receivers at the store, and the positioning receivers may communicate the received tag positioning signal characteristics to a controller and the position of the tags may thus be computed. Yet alternatively or in addition, the tags may compute their position by using a positioning system such as the Global Positioning System (GPS) system or Assisted GPS or Differential GPS. Alternatively or in addition the tags may sense one or several fields, such as gravity, magnetic fields and/or electromagnetic fields and compare this raw data to known maps of such fields or send the sensed data to positioning sub-system for mapping to estimate the location of the tag.

The control sub-system may have a number of servers, e.g. for the following purposes: 1) one or more store gateway servers or gateway devices or devices otherwise providing network connection for arranging a connection to the internet from EAS network in the store and the tags, 2) one or more servers communicating with the store gateways, 3) one or more servers for storing and/or handling data e.g. a control server, and 4) one or more servers for providing access to the EAS system such as web servers or $3^{rd}$ party integration servers. It needs to be noted here that various devices may provide functionalities of these servers, for example one or more elements of the EAS network in the store may also provide an internet connection, e.g. through a 2G/3G/4G or other cellular network modem, to other elements and the tags in the EAS system, thereby making it unnecessary to have a dedicated router. The control sub-system may be able to receive information from the tags, e.g. the status of a tag and/or the position of the tag. The control sub-system may also be able to send information and commands to the tags, e.g. for changing indications the tag is providing or for changing the alarm mode of a tag.

The location system (positioning sub-system) inside a facility communicates with the EAS tag for determining the location of the electronic article surveillance tag. E.g. if the EAS tag detects a magnetic field being applied to remove the pin or detects that a lanyard attached to the tag is broken (the electrical connection is broken). The positioning system may also be a system not limited to the inside of the facility. The location system may be such that it is able to locate the tag precisely, using spatial coordinates, or it may be approximate, i.e. able to locate the tag within a certain radius of an antenna or such. The radius may be for example 2 to 5 meters.

An EAS system for a facility may comprise at least one electronic article surveillance tag, a location system of the facility and at least one alarm device providing a silent alarm and/or audible alarm. The system may be used facilities such as in a shopping complex, a retail chain, a merchandise store, a shop, an office store or any other facility which requires inventory control and prevention of theft or unauthorized removal of articles.

The concerned person(s) of the shop or other facility can access the server system mentioned above by using their communication devices which include but are not limited to a laptop and a mobile phone. The concerned person can be an owner of the facility, a supervisor of the facility, a manager of the facility, and the like. In an example, if the EAS tag is removed from the article, the information is communicated to the server system. If the removal is done in allowed place such as by the cash register, the removal does may not trigger an alarm. If the removal is done outside of allowed areas and/or if a personnel tag is not close enough (as will be explained in more detail below), the alarm may be triggered. In addition, if the article and the EAS tag are moved to a non-allowed area (say outside the facility), an alert alarm may be initiated.

The EAS tag may be a sensor tag that is affixed to the article which is to be detected in such a way that it cannot be easily removed by a customer in the facility. Usually, the alarm system depends upon the feature that the attachment mechanism is constructed such that it can only be removed by the use of a specialized tool which is only in the possession of the store personnel at the checkout register or exit port for the facility or shop. In the event that an EAS tag is not removed from a protected article prior to exiting the facility, an alarm is triggered. The alarm is not triggered when the EAS tag is removed from the article in an authorized area. An authorized area may be an allowed area inside the facility where the removal of the EAS tag is allowed. The authorized area may be an area close to cash registers, e.g. within 2-3 meters from cash registers, defect control area, a store room, and the like. There may be multiple authorized areas in one facility. An alarm may be triggered when the EAS tag is removed from the article in an unauthorized area. This second area may be an area inside the trial rooms, or any other area where the removal of EAS tag is not allowed, and there may be multiple unauthorized areas in a facility and with respect to a facility. The tag may also be configured to raise alarm if the EAS tag is taken outside a third defined area, such as outside the total area of the facility, irrespective of whether the tag is removed or not.

One or more antennas may be placed at the exits and/or entrances to the facility. These antennas may set up zones, sometimes referred to as interrogation zones, in which the EAS tag may be sensed. At least one antenna may serve the function of sending out what is called an interrogation signal. The EAS tag on the article is then affected by this signal and responds with a signal either by back-scattering modulation or producing a signal of its own. Either the same antenna that sends out the interrogation signal or other additional antennas can sense the signals from the EAS tag. If a tag is detected in these interrogation areas, it may be determined that the tag and the tagged article is being removed from the facility, and an alarm may be initiated. Also, if the tag is positioned to be in one of the interrogation areas, but it does not respond to interrogation within the zone created by the antennas, it may be presumed that the article is being removed without purchase, and alarms are set off. These alarms may be audible alarms for general broadcast, silent alarms in the form of a light at a check-out counter or security station, and the like.

The alarm system may also comprise a personnel tag, i.e. a tag identified to the personnel of the facility and carried by each member of the personnel. In this embodiment, the system may only allow removal of the EAS tag within an authorized area if the personnel tag is within a pre-determined distance, e.g. within 2-5 meters of the EAS tag. In this embodiment, the system may also allow removal of the EAS tag outside pre-defined authorized areas, i.e. the personnel tag may create an ad hoc-authorized area around itself.

In a facility the sales items may be equipped with an electronic article surveillance tag and the facility may be equipped with a location (positioning) system. The electronic article surveillance tag may communicate with the location system for checking the location of the electronic article surveillance tag. If a magnetic field sensor in the tag detects the presence of an unusually strong magnetic field or the electrical coupling sense that the electrical connection is broken, it may be determined that the tag is being tampered with, if the tag is outside an authorized area. Further, the means for initiating an alarm may initiate the alarm if the electronic article surveillance tag is outside an authorised area.

The location system installed in the facility may utilizes the inputs from base stations and the signal transmitted by the EAS tag to determine the location of the EAS tag. The location system and a monitoring system in association with a server system may determine the location of the EAS tag and the article. The location system may use one or more base stations, and for example one base station may be equipped with two or more antennas, allowing a single base station to detect location with sufficient accuracy.

Figure 1:
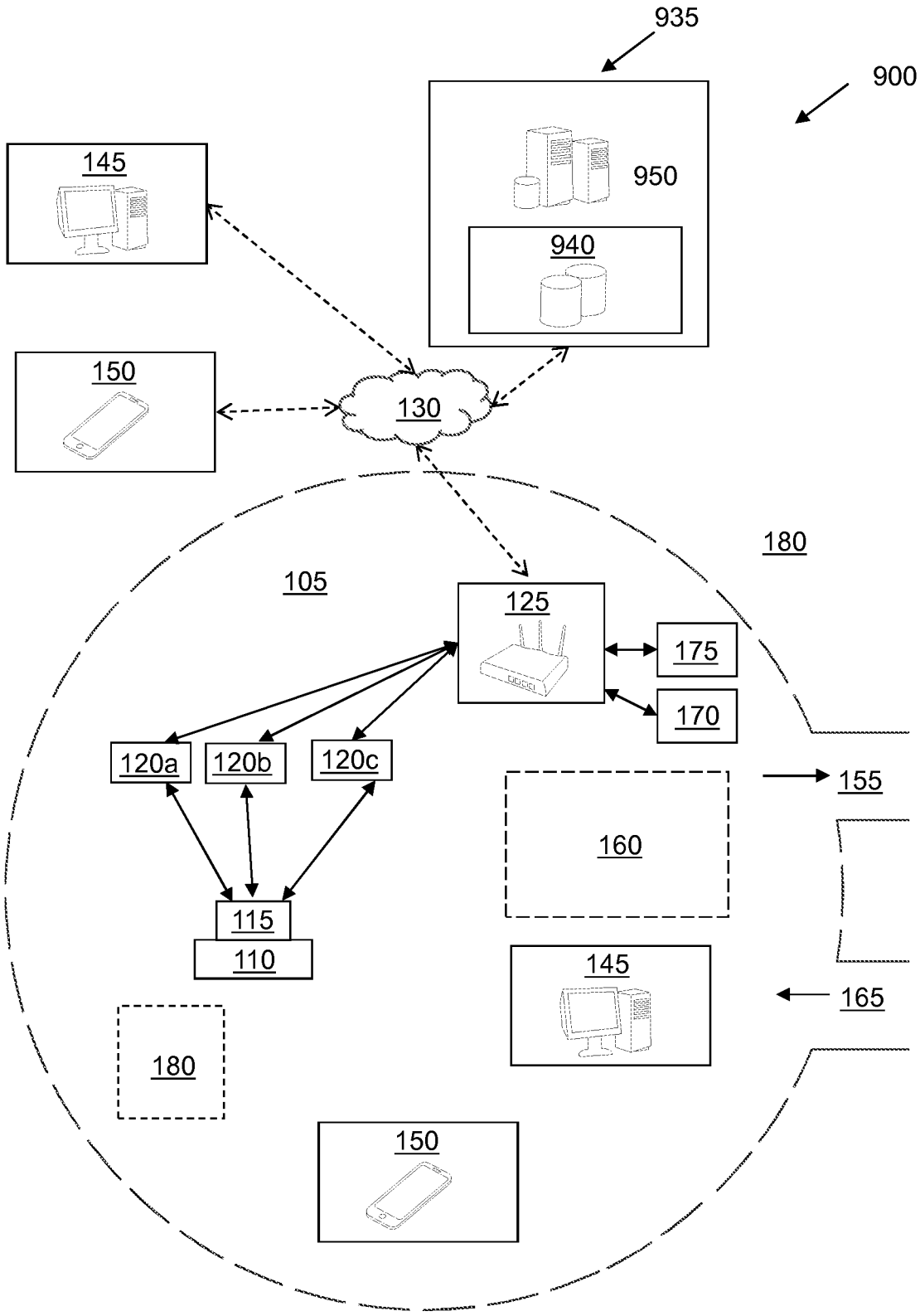

FIG. 1 shows an electronic article surveillance (EAS) system and devices according to an embodiment. In the EAS system 900 arranged to serve a facility 105 to cover the area of the facility (dashed line), there are one or more servers 950 and/or databases 940 comprising one or more processors and memory, and the memory comprises computer program code for carrying out the functionality of the server or database. In the EAS system 900, there are also a number of EAS tags 115, and these tags are attached to articles 110 that require surveillance. For example, as shown in FIG. 1, the EAS tag 115 is attached to an article 110. The EAS tag 115 can be attached to the article 110 by locking fasteners.

The EAS tag 115 may have a transmitter such as a Bluetooth low energy (BLE) transmitter or ultra-wide band (UWB) transmitter, and the facility 105 may comprise a base station 120*a*, a base station 120*b*, and a base station 120*c*, and more. The base stations 120*a*, 120*b* and 120*c* receive the signals transmitted by the EAS tag 115. The signals transmitted by the EAS tag 115 enable determination of location of the EAS tag 115 attached to the article 110. The base stations 120*a-c* in association with a location system 170 and a monitoring system 175 communicate the location via a router 125 to a control sub-system 935 over a communication network 130, and the control sub-system 935 may comprise a database 940.

FIG. 1 also shows an authorized area 160, located inside the facility 105 where the removal of the EAS tag 115 from the article is allowed, as well as a second (unauthorized) area 180, where removal of the EAS tag 115 is not allowed and triggers the alarm. Furthermore, one or more antennas can be placed at the exits 155 and entrances 165 to the facility 105.

It may be noted that FIG. 1 shows the EAS tags 115 attached to articles 110; however, those skilled in the art would appreciated that the EAS tag 115 or similar EAS tags can be attached to different products of different character, form and composition. In addition, it may also be noted that the EAS system 100 can have a different number of system components which will enable the inventory control and theft control of different articles. For example, there can be multiple base stations/antennas and multiple allowable areas defined in the facility 105.

The control sub-system 935 can be accessed by using communication devices which include for example a laptop 145 and a mobile phone 150. The control sub-system may be completely or partially located inside the facility 105, or the control sub-system may reside completely or partially outside the facility 105, e.g. in a computer network. There may be a dedicated router inside the facility to connect the on-facility devices to the control sub-system. Additionally or alternatively, the on-facility devices may form a mesh network and one or more of the devices may provide a connection from the mesh network to the internet or other network and/or to the control sub-system.

As mentioned, the system for electronic article surveillance may comprise one or more processors and memory including computer program code, and the memory and the computer program code are configured to cause the system to perform the following functions. The system may determine, store, monitor and use status information of the EAS tags 115. The control sub-system 935 may receive a status message from the electronic article surveillance tag 935 over the communications connection 130 at a first time instance. For example, the EAS tag may send a status message stating that the tag is at location 180 and the pin or pins are in place in the locking fasteners. The control sub-system may determine the tag to be in a first state based on the status message, for example that the tag is intact and that the tag is in an unauthorized area 180 where the pin(s) cannot be removed, that is, the tag cannot be removed from the article 110. The control sub-system 935 may store the state information in a memory, e.g. a local volatile or non-volatile memory and/or a database 940. The control sub-system 935 may then form a control message based on the status message, and send the control message to the tag 115. The control message may comprise control instructions that are formatted in a structured message that the EAS tag can decode. The control instructions may be arranged to alter the operation of the EAS tag, change the tag's state or cause it to carry out a function. The EAS tag 115 may, based on the receiving of the control message, then alter its operation. For example, the tag may change its alarm operation from performing a silent alarm to performing an audible alarm to be sounded when the article 110 is detached from the tag 115. Alternatively or in addition, the tag may change the interval of transmitting status messages, e.g. to be shorter or longer based on the control message. Alternatively or in addition, the tag may change indication mode, that is, how it indicates the state of the tag or the article 110 to which it is attached. Some different states have been described in Table 1.

TABLE 1

| Statuses | |
|---|---|
| State | Description |
| MAGNET_NEAR | Magnetic tool for removing tag from article is detected near the tag |
| SIGNAL_LOST | Base station signal is lost, or communication is otherwise broken |
| UNAUTHORIZED_AREA | Tag resides in unauthorized area currently, and tag removal causes an alarm |
| AUTHORIZED_AREA | Tag resides in an authorized area, and proper tag removal is allowed |
| BUZZER_ON | Tag's buzzer is on |
| LED_ON | Tag's led is on |

TABLE 1-continued

| Statuses | |
|---|---|
| State | Description |
| ACCELEROMETER_ACTIVE | Accelerometer is active, movement is detected |
| LANYARD_CUT | Lanyard has been severed or damaged, tampering detected |
| ALARM_ON | Alarm is on |
| ALARM_OFF | Alarm is off |

The tag 115 may transmit another status message that is received from the electronic article surveillance tag to said control sub-system 935 over a communications connection 130 at a second time instance. The control sub-system may determine that the tag 115 is in a second state of said tag based on the first status message and the second status message together, or based on the earlier state of the tag (determined from the first status message) and the now received second status message. For example, the tag may transmit a status message that informs the control sub-system that the EAS tag is now in an unauthorized area 180 and that the two locking fasteners are intact and holding pins, and that the lanyard between the locking fasteners is intact. Next the tag may transmit a status message that the lanyard is not intact. The control sub-system 935 may then determine that the EAS tag has been tampered with, perhaps removed from the article 110. Based on this determining, the control sub-system may send a second control message from the control sub-system to the EAS tag, and the second control message may cause the tag to alter the operation of said tag based on said second control message. For example, the tag may sound an alarm based on the control message or alter indications of the tag status.

The status monitoring may in addition or alternatively also be arranged so that events of status change are detected by the EAS tag 115, and event information on the events are stored into a memory of the tag. The event information may comprise the number of status change events, time of status change events, and/or a list of status change events. Other information like the signal strength of base stations 120*a-c* or position of the tag may also be stored with the events. Such event information may be completely or in part sent from the EAS tag to the control sub-system 935 in one or more status messages, for example the above mentioned status messages. The control sub-system may then determine the current or earlier state of the tag based on the event information.

Such logged event information may provide a more reliable way to detect theft attempts. For example, if a thief places the tag and the article inside a shielding container like a metal foil bag to prevent the transmissions from the EAS tag to be carried to the control sub-system 935, the tag may nevertheless log the removal of the lanyard or pin from the locking fastener and also detect the re-attachment of the lanyard or pin to the locking fastener. When the tag is removed from the shielding bag, it is in an intact state, but the event history shows that the tag has been tampered with. Once the control sub-system receives the state history, the theft attempt can be detected and an alarm can be made.

Any of the above control messages and status messages may carry a sequence number, and it may thus be possible to determine whether messages have been missed.

Figure 2:
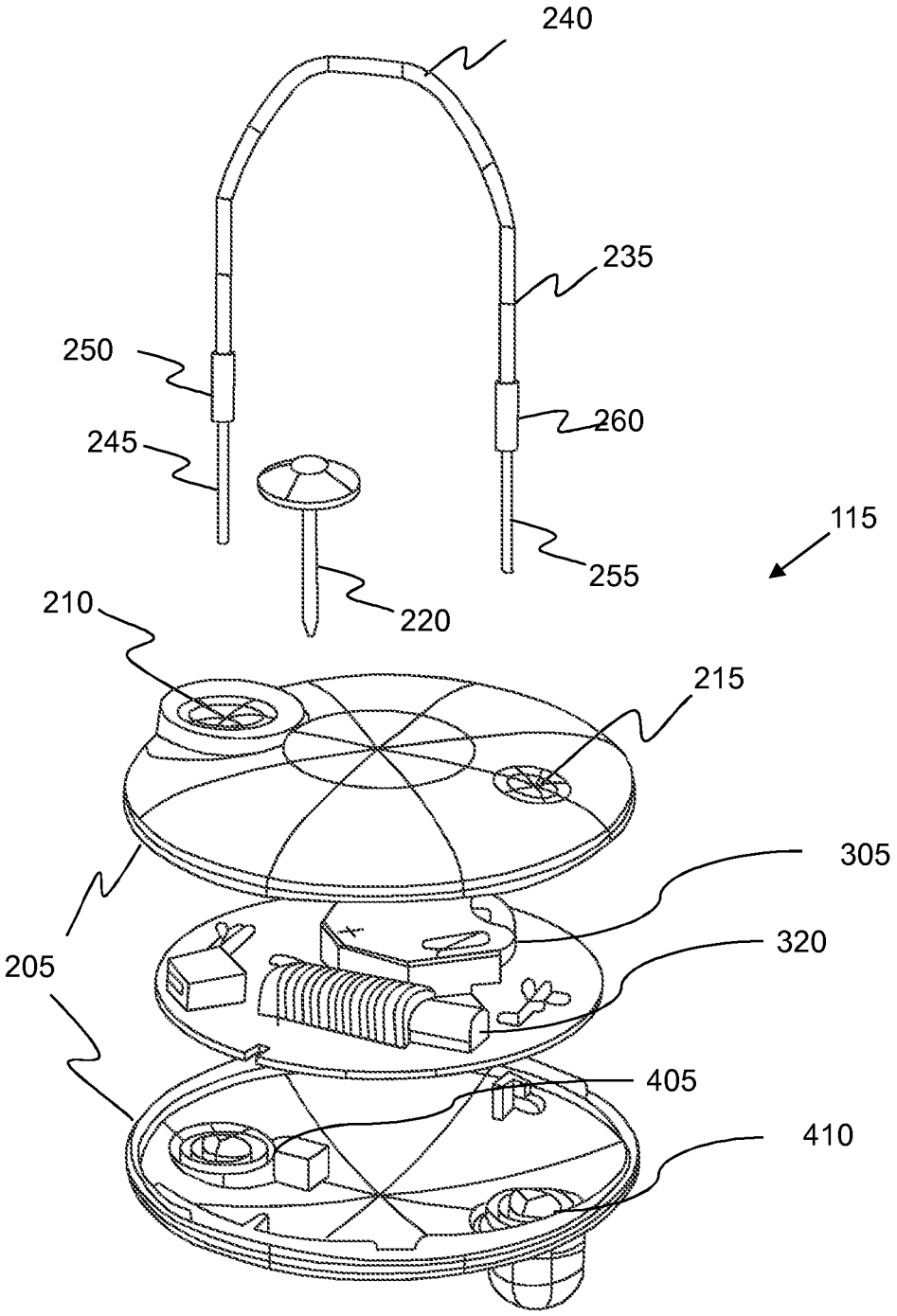
FIG. 2 shows an electronic article surveillance tag according to an embodiment.

FIG. 2 shows an electronic article surveillance tag 155 that may be used in the EAS system 900.

The EAS tag 115 is attached to the article 110 with a locking fasteners/attaching mechanism. The locking fasteners/attaching mechanism can utilize a pin based attaching element and a lanyard with a pin head as attaching elements. In other words, the EAS tag 115 is configured to be attached to the article 110 by either a pin based attaching element and/or a lanyard with pin heads as the attaching elements. The EAS tag 115 has a body 205. The body 205 encapsulates different components of the EAS tag 115. The body 205 may have a first opening 210 and a locking mechanism 210 and possibly a second opening adapted to receive a pin 220 as an attaching mechanism. For example, to protect the article 110, the pin 220 is inserted into the first opening 210.

In addition, the first opening and locking mechanism 210 is adapted to receive a first end 245 of the lanyard 235 and the second opening and locking mechanism 215 is adapted to receive a second end 255 of the lanyard 235. The lanyard 235 may comprise a conducting wire 240. Both the ends of the conducting wire 240 of the lanyard 235 may have a pin shape head. For the sake of clarity, a first end 245 of the conducting wire 240 of the lanyard 235 is shown to have a pin head 250 and a second end 255 of the conducting wire 240 of the lanyard 235 is shown to have a pin head 260. The electro-mechanical construction of the EAS tag 115 thus allows the same EAS tag body 205 to be used with the pin type attachment (earlier) and the lanyard type attachment configuration.

The body 205 of the EAS tag 115 encapsulates different components of the EAS tag 115 for example for sensing a magnetic field, means for communicating with a location system, means for allowing deactivation of the alarm function, means for initiating an alarm and the like. The EAS tag 115 may include a battery holder 305, a battery 310 for powering the EAS tag 115, means for activating security gates at the exit (or entrance) of the facility 320, and an antenna for communication and positioning purposes.

The electronic article surveillance tag 115 may comprise at least one processor, memory including computer program code, the memory and the computer program code being configured to, with the at least one processor, cause the tag to perform the following functions. As described earlier in the context of the EAS system, the EAS tag 115 may transmit a status message from the electronic article surveillance tag to a control sub-system 935 of an electronic article surveillance system 900 over a communications connection 130 at a first time instance. The tag 115 may then receive a control message from the control sub-system, where the control message has been formed by the control sub-system using information in said the status message. When the tag 115 receives the control message, the tag 115 may alter its operation based on the control message.

The control message may cause the tag to change its communication interval to the control sub-system, to change the positioning interval, the indication type for indicating tag or article status, alarm type and mode, alarm volume, communication protocol etc. The electronic article surveillance tag may comprise an alarm unit for causing an alarm, where the alarm unit is capable of causing an alarm in at least a first alarm mode and a second alarm mode, and the computer program code in the memory of the tag being run at the processor may cause the tag to control the alarm unit to operate in the first alarm mode or the second alarm mode based on the control message. The EAS tag may comprise an indicator for indicating a status of the tag, said electronic article surveillance system or an article to which the tag is attached. The indicator may be capable of indicating the status in a plurality of indication modes, and there may be a controller (e.g. processor of the tag) arranged to set an indication mode of the tag among the plurality of indication modes based on the control message received from the control sub-system of the electronic article surveillance system. In this manner, the battery state, tag tampering state, lanyard intactness state, the article 110 properties etc. may be indicated. The tag may also be caused by a message from the control sub-system to change its mode to "alarm on" mode, for example when the tag moves to an unauthorized area. The tag may also be caused by a message from the control sub-system to give a short, e.g. 3 second long, audible signal, for example when a member of the personnel needs to locate the tag and/or has otherwise instructed the system to cause the tag to give the audible signal. Similarly, a short visible signal like a blinking LED may be given. Generally, there may be various different modes into which the tag may be ordered to either separately or simultaneously in effect, for example tag active, tag inactive (tag not in use), silent alarm mode (buzzer on tag not activated on alarm), audible alarm mode (buzzer activated on alarm), tag in lanyard attachment mode, tag in pin attachment mode, tag displays internal state of tag (e.g. power supply status, positioning status and alarm mode), tag tracks movement and/or tag does not track movement.

As explained earlier, state history of the EAS tag may also be stored in the tag memory. The tag 115 may comprise state memory for storing state information, and a control unit arranged to form and store information on state of said tag in the state memory. The control unit may be arranged to form the first status message based on the information on state maintained in the memory of the tag. The message may comprise state information. Also, the message may be formed when the status history of the tag fulfills certain criteria.

The control unit may be arranged to detect events of status change of the tag, and to store event information on said events into a memory of the tag, wherein the event information comprises number of status change events, time of status change events, and/or a list of status change events. The control unit may cause the tag to send the event information from the tag to the control sub-system in a status message for determining a state of the tag based on the event information.

The EAS tag may have a movement sensor for determining movement state of the tag, for example that the tag is not moving or that the tag is moving, and/or the speed of the movement. There may be a control unit configured to form a status message when the movement state indicates that said tag is moving.

Any or all status messages may be made to contain position information of the tag and status information of said tag.

Figure 3:
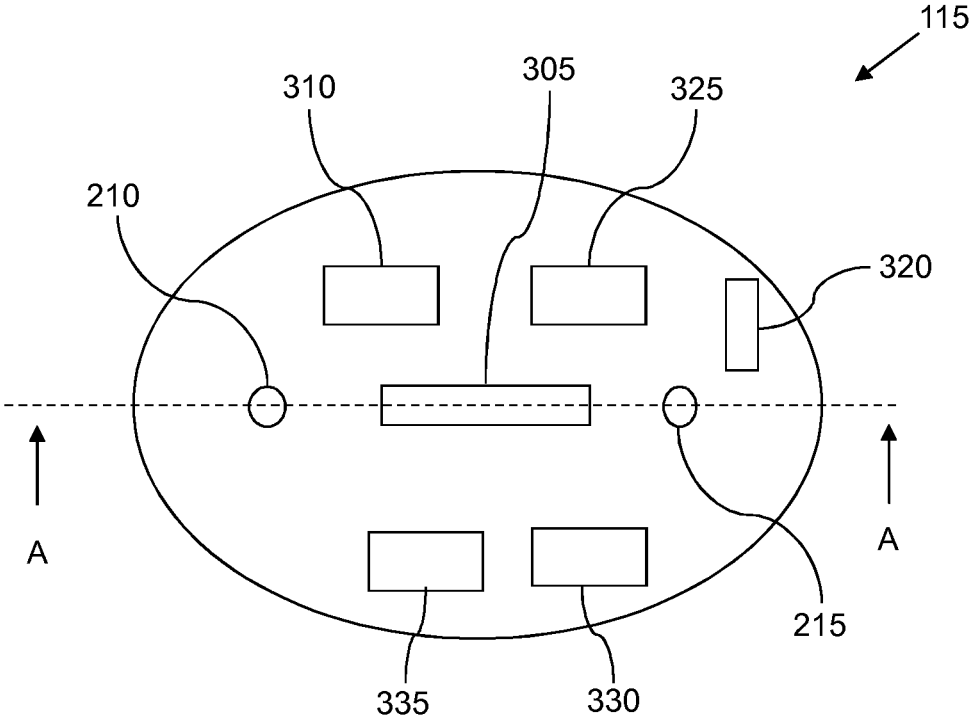
FIG. 3 shows a block diagram of an electronic article surveillance tag according to an embodiment.
Figure 3:
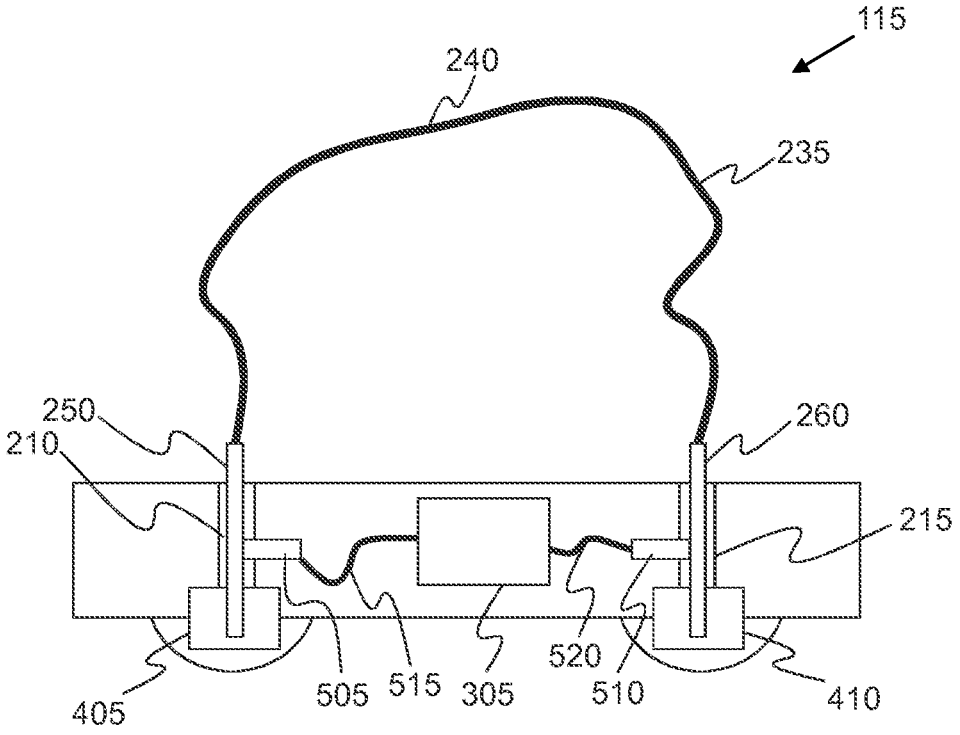

FIG. 3 shows a block diagram of an electronic article surveillance tag according to an embodiment.

The EAS tag 115 may comprise communication means such as radio communication module 330. The EAS tag may comprise one, two or more locking fasteners 335. As explained earlier, the EAS tag 115 may have a first opening 210 and the second opening 215 for detachably inserting the pin 220 or pin head 250 at the first end 245 of the conducting wire 240 of the lanyard 235 and the pin head 260 at the second end 255 of the conducting wire 240 of the lanyard 235 from outside into the EAS tag 115. In the pin type attachment configuration, the inserted pin 220 is securely held with a locking mechanism 405. In the lanyard type attachment configuration, the pin head 250 at the first end 245 of the conducting wire 240 of the lanyard 235 is securely held with the locking mechanism 405. Similarly, the pin head 260 at the second end 255 of the conducting wire 240 of the lanyard 235 is securely held with the locking mechanism 410. The locking mechanism may be released with the help of a special tool, e.g. such tool that contains a strong magnet. Different kinds of attachment and locking mechanisms may be used, including but not limited to pins, lanyard, spider-type multi-string attachment and so on.

In FIG. 3, the EAS tag 115 with the lanyard 235 connected to the first opening 210 and the second opening 215 is illustrated. The lanyard 235 consists of the conducting wire 240, the pin head 250 connected to the conducting wire 240 at the first end 245 and the pin head 260 connected to the conducting wire 240 at the second end 255. The pin head 250 is locked in the first opening 210 with the locking mechanism 405. The locking mechanism 405 can be opened with a strong external magnet. The pin head 260 is locked in the second opening with the locking mechanism 410. The locking mechanism 410 can be opened with a strong external magnet. A conductive element 505 is configured to be in contact with the pin head 250 when the lanyard 235 is used as an attaching element. Similarly, a conductive element 510 is configured to be in contact with the pin head 260. The conductive elements 505 and 510 are connected with wires 515 and 520 respectively to the control unit 305. The control unit 305 may be configured to monitor whether an electrical connection is present via the lanyard 235.

The control unit 305 may comprise or be connected to a memory for storing data and instructions. The control unit 305 may be a processor e.g. a microcontroller, and when computer program code from the memory is run on the control unit 305, the control unit 305 may cause the tag to perform various functionalities. For example, the control unit may detect and store various status information of the tag and store it into the memory.

A magnetic field sensing element 335 in the electromagnetic circuitry of the EAS tags 115 may sense unauthorised usage of the external magnet 610. In case of unauthorised removal, the element 335 activates to sense strong electromagnetic field and may trigger an alarm of the sound source 320, and may cause a status message to be sent and/or the status to be stored into the memory. The alarm from the sound source 320 is not triggered if a location detector in the EAS tag 115 informs that the EAS tag 115 is in an authorized area.

The means for communication comprise a radio communication module. The radio communication module can be for example a Bluetooth low energy module or a radio module using ultra-wide band technology. The EAS tag may communicate via any appropriate communication means. The EAS tag can have a radio frequency transmitter or any other suitable signal transmission means. The EAS tag may also comprise a radio frequency receiver. The facility in which the EAS tag is used can have at least one base station, such as one, two, three, four or five base stations. The base stations receive the signals transmitted by the EAS tag and these signals enable determination of location of the EAS tag attached to the article. In other words, the location of the article is determined by utilizing the signals transmitted by the EAS tag. The base stations can be used in association with a location system and a monitoring system, and together they can communicate the location via a router to a control sub-system over a communication network. The control sub-system may include a database for storing business rules, locations, history, videos from surveillance cameras, and the like.

FIGS. 4*a*, 4*b* and 4*c* show flow charts for methods for electronic article surveillance according to an embodiment. The flow charts relate to a contro sub-system of an EAS system, an EAS tag in such a system, and the total EAS system, respectively.

First, with respect to FIG. 4*a*, a method of controlling an electronic article surveillance tag in an electronic article surveillance system is described, where the tag comprises a detector for detecting tampering, and the system comprises a positioning sub-system or some positioning means for determining a position of the tag, and a control sub-system for controlling operation of the system and the tags of the system. In phase 1010, a first status message from the electronic article surveillance tag may be received to the control sub-system over a communications connection at a first time instance. In phase 1012, the control sub-system may determine a first state of the tag based on the first status message. In phase 1014, the state may be stored in a memory. In phase 1016, a first control message may be sent from the control sub-system to the tag, the control message being formed based on the first state, and the message being suitable for altering the operation of said tag based on the first control message.

With respect to FIG. 4*b*, a method of operating an electronic article surveillance tag in an electronic article surveillance system is described, where the tag comprises a detector for detecting tampering, and the system comprises a positioning sub-system or some positioning means for determining a position of the tag, and a control sub-system for controlling operation of the system and the tags of the system. In phase 1020, a first status message from the electronic article surveillance tag may be transmitted to the control sub-system over a communications connection at a first time instance. In phase 1022, a first control message may be received from the control sub-system to the tag, the control message being formed based on the first state, and the message being suitable for altering the operation of said tag based on the first control message. In phase 1024, the operation of the tag may be altered based on the control message.

With respect to FIG. 4*c*, a method of operating an electronic article surveillance system comprising EAS tags is described, where the tag comprises a detector for detecting tampering, and the system comprises a positioning sub-system or some positioning means for determining a position of the tag, and a control sub-system for controlling operation of the system and the tags of the system. In phase 1030, the tag status may be determined. As described elsewhere in this disclosure, the internal or external status of the various components and environment may be used in this determining. In phase 1032, the position of the tag may be determined. In phase 1034, the tag movement status may be determined. In phase 1036, event information on changes in state is stored in the tag memory. In phase 1040, status messages based on statuses, position, movement and/or events may be formed. In phase 1040, a first status message from the electronic article surveillance tag may be sent to the control sub-system over a communications connection at a first time instance. In phase 1042, the control sub-system may determine a first state of the tag based on the first status message. In phase 1044, one or more control messages for the same or other tags may be formed, the control message being formed based on the first state, and the message being suitable for altering the operation of said tag based on the first control message. In phase 1046, a first control message may be sent from the control sub-system to the tag or another tag. In phase 1048, the operation of the tag may be altered based on the control message.

In relation to the above flow charts, other steps may be carried out, and these are described below.

A second status message may be received from the electronic article surveillance tag to the control sub-system over a communications connection at a second time instance. The control sub-system may determine a second state of the tag based on the first status message and the second status message. A second control message may be sent from the control sub-system to the tag, the second control message being formed based on the second state. The operation of the tag may be altered based on the second control message. In other words, more than one status message may be used together to determine the status of the tag.

The control messages may comprise a command to alter alarm mode of the tag, and the method may comprises setting the alarm mode of the tag based on a control message.

A control message may comprise a command to alter indication mode of the tag, and the method may comprise setting the indication mode of the tag based on the control message.

information on state of the tag may be maintained in a memory of the tag, and any status message may be formed based on the information on state maintained in the memory of the tag.

Information on movement state of the tag of the tag may be determined, and a status message may be formed and/or transmitted when the movement state indicates that the tag is moving.

A status message may comprise position information of the tag and status information of the tag.

Events of status change may be detected by the tag, and event information on the events may be stored into a memory of the tag. The event information may comprise at least one of the group of: number of status change events, time of status change events, and a list of status change events. Such event information may be transmitted from the tag to the control sub-system in one or more status messages. The event information may be used in determining the state of the tag.

In addition to the above method for electronic article surveillance, the tags and the system may be operated as follows. An operator inserts the pin 220 in the first opening 210 of the EAS tag 115 to attach the article 110 with the EAS tag 115. The status of the pin 220 and status of the magnetic field detection element 335 is monitored. If there is any change in the status of the pin 220 and the element 335, then each of the status of the pin 220 and the element 235 is monitored separately and separate statuses may be determined for them. The control unit 305 checks the removal of the pin 220. If the pin 220 is found to be not removed, then no action takes place. However, if the pin 220 is found to be removed, the controller 305 in communication with the base stations 120*a-c*, the monitoring system 175 and the location system 170 checks whether the removal is in an allowed area 160. If the removal of the pin 220 is performed in an allowed area 160, then no action takes place. However, if the pin 220 is removed elsewhere than in the allowed area 160, an alarm is triggered. Similarly, the controller 305 may check whether the element 335 detected any change in the magnetic field. If a change in the magnetic field has not been detected, then no action takes place. However, if a change in the magnetic field has been detected, the microcontroller 305 in communication with the base stations 120*a-c*, the monitoring system 175 and the location system 170 checks whether the change in magnetic field has taken place in an allowed area 160. If the change has taken place in an allowed area 160, then no action takes place. However, if the change has been detected outside the authorized area 160 or in an unauthorized area 180, an alarm is triggered.

The EAS tag 115 may be used with the lanyard 235 connected to the first opening 210 and the second opening 215, as described earlier. The operator inserts the pin head 250 at the first end 245 of the conducting wire 240 of the lanyard 235 and the pin head 260 at the second end 255 of the conducting wire 240 of the lanyard 235 into the locking fasteners of the EAS tag 115 in order to attach the lanyard to the tag from both ends in a detachable manner. Magnetic field detector 335 is monitored. If the element 335 does not detect an external magnetic field, than no action takes place. If the detector 335 detects an external field, the microcontroller 305 in association with the base station 120*a-c*, the monitoring system 175 and the location system 110 detects whether the EAS tag 115 is in an authorized area. If the EAS tag 115 is in an authorized area 160, the lanyard 235 is allowed to be removed. If the EAS tag 215 is not in the allowed area 160, an alarm is triggered.

On the other hand, the controller 305 may monitor the electrical connection between the first locking fastener 210 and the second locking fastener 215. If the electrical connection between the first opening 210 and the second opening 215 is proper (it is detected that the lanyard conducts electricity between first opening and second opening), no action takes place. If an electrical connection between the first opening 210 and the second opening 215 is found to be improper (disconnected or being too high or low in resistance or improper in impedance), the controller 305 monitors the element 335. If the element 335 does not detect a change in the magnetic field but the connection is lost between the openings, an alarm is triggered, provided that the item is outside an authorized area 160 and/or a personnel tag is not within the pre-defined distance or the item. The lack of magnetic field (no pin removal tool close to the tag) in this case indicates that the lanyard 235 has been cut. If the element 335 detects a magnetic field, the controller 305 in association with the base station 120*a-c*, the monitoring system 175 and the location system 170 detects whether the EAS tag 115 is in an allowed area 160. If the EAS tag 115 is not found to be in an authorized area 160, an alarm is triggered. If the EAS tag 115 is in an authorized area 160, the lanyard 235 is allowed to be removed without causing an alarm.

FIGS. 5*a* and 5*b* show message formats for controlling an electronic article surveillance system and tag. In FIG. 5*a*, an example message format for providing status information from an EAS tag to an EAS system is shown. The message may be encapsulated in one or more packets suitable for data transmission over a communications connection. The message may comprise various data fields. There may be a field for indicating an identifier of the tag that is transmitting the message, for example and ID code, an IP address or a hardware address. The message may carry location data of the tag. For example, position coordinates, strength of gravity, strength of different electromagnetic fields, access signal strengths of base stations, access point or wireless network names or other location-dependent data may be transmitted in the message. There may also be a field for transmitting status data of the tag. For example, pin insertion status, battery cover status, lanyard conductivity status, magnetic field detection status, temperature, humidity, battery level, ambient lighting level or sound level, and other data dependent on the tag status or environment may be transmitted. In addition, event data on current and past events may be transmitted (as described earlier, event data may be stored in a tag memory). Data on the associated article to which the tag is attached may also be transmitted. Such data may exist in the tag memory. Also other data may be transmitted. The previous fields may exist or not in the message, and there may be zero, one or more of any of the fields.

In FIG. 5*b*, an example message for controlling an EAS tag operation in response to a status of a tag is shown. The message may comprise a field for indicating the tag to which the message is intended. There may be a field for one or more control instructions. These instructions are in such format that the EAS tag is able to decode them and alter its operation. There may also be indication data such as image, text, sound or other data that the tag can use to indicate its status or the status of the article to which it is attached.

The various embodiments of the invention can be implemented with the help of computer program code that resides in a memory and causes the relevant apparatuses to carry out the invention. For example, a device may comprise circuitry and electronics for handling, receiving and transmitting data, computer program code in a memory, and a processor that, when running the computer program code, causes the device to carry out the features of an embodiment. Yet further, a network device like a server may comprise circuitry and electronics for handling, receiving and transmitting data, computer program code in a memory, and a processor that, when running the computer program code, causes the network device to carry out the features of an embodiment.

A computer program product may be provided embodied on a non-transitory computer readable medium, comprising computer program code configured to, when the program code is executed on at least one processor, cause an apparatus or a system to carry out the appropriate operations. For an EAS system, the program code may cause the apparatus or system to receive a first status message from an electronic article surveillance tag to a control sub-system over a communications connection at a first time instance, determine by the control sub-system a first state of the tag based on the first status message, store the first state in a memory, and send a control message from the control sub-system to the tag, the control message being formed based on the first state for altering the operation of the tag based on the first control message. For an EAS tag, the computer program code may cause the tag to transmit a first status message from the electronic article surveillance tag to a control sub-system of an electronic article surveillance system over a communications connection at a first time instance, receive a first control message from the control sub-system to the tag, the control message being formed using information in the first status message, and alter the operation of the tag based on the first control message. Generally, a computer program product embodied on a non-transitory computer readable medium, comprising computer program code may be configured to, when executed on at least one processor, cause an apparatus or a system to carry out the method as described in the context of FIGS. 4*a*, 4*b* and 4*c*, and to carry out any other functionality described earlier.

It is obvious that the present invention is not limited solely to the above-presented embodiments, but it can be modified within the scope of the appended claims.

The invention claimed is:

1. A method of controlling an electronic article surveillance tag in an electronic article surveillance system, said tag comprising a detector for detecting tampering, and said system comprising a positioning sub-system for computing a position of said tag and a control sub-system for controlling operation of said system, said method comprising:

receiving a first status message from said tag to said control sub-system over a communications connection at a first time instance, said first status message comprising status data of said tag, computing the position of said tag by said positioning sub-system, determining by the control sub-system a first state of said tag based on said status data and said computed position of said tag, determining whether another tag identified to personnel in the electronic article surveillance system is within a predetermined distance of the tag, storing said first state in a memory of the system, sending a first control message from said control sub-system to said tag, said first control message being formed based on said first state and whether said another tag is within the predetermined distance of said tag, and altering the operation of said tag based on said first control message.

2. The method according to claim 1, wherein said first control message comprises a command to alter an alarm mode of said tag, and said method comprises:

setting said alarm mode of said tag based on said first control message.

3. The method according to claim 1, wherein said first control message comprises a command to alter an indication mode of said tag, and said method comprises:

setting said indication mode of said tag based on said first control message.

4. The method according to claim 1, comprising:

maintaining information on a state of said tag in a memory of said tag, and forming said first status message based on said information on the state maintained in said memory of said tag.

5. The method according to claim 4, comprising:

determining information on a movement state of said tag, and forming said first status message when said information on the movement state of said tag indicates that said tag is moving.

6. The method according to claim 1, comprising:

detecting events of status change by said tag, storing event information on said events of status change into a memory of said tag, wherein said event information comprises at least one of the group of: a number of status change events, a time of status change events, and a list of status change events, sending said event information on said events of status change from said tag to said control sub-system in said first status message, determining said first state based on said event information on said events of status change.

7. The method according to claim 1, wherein said first status message comprises information on tampering of the tag, and said first state is determined based on said information on tampering of the tag.

8. The method according to claim 7, wherein an alarm is caused if said tampering is detected in an unauthorized area or outside an authorized area based on said computed position of said tag.

9. The method according to claim 1, wherein the status data indicates a tampering with the tag.

10. The method according to claim 1, wherein the status data indicates that locking fasteners of the tag are intact.

11. An electronic article surveillance tag comprising a tampering detector, at least one processor, a memory including computer program code, the memory and the computer program code configured to, with the at least one processor, cause the tag to perform at least the following:

transmit a first status message from said tag to a control sub-system of an electronic article surveillance system over a communications connection at a first time instance, said first status message comprising status data of said tag, receive a first control message from said control sub-system to said tag, said first control message having been formed based on said status data, a computed position of said tag, and whether another tag identified to personnel in the electronic article surveillance system is within a predetermined distance of the tag, and alter an operation of said tag based on said first control message.

12. The electronic article surveillance tag according to claim 11, comprising:

an alarm unit for causing an alarm, said alarm unit being configured to cause the alarm in at least a first alarm mode and a second alarm mode, computer program code to cause said tag to control said alarm unit to operate in said first alarm mode or said second alarm mode based on said first control message.

13. The electronic article surveillance tag according to claim 11, comprising:

an indicator for indicating a status of said tag, said indicator being configured to indicate said status of said tag in a plurality of indication modes, a controller arranged to set an indication mode of said tag among said plurality of indication modes based on a control message received from said control sub-system of said electronic article surveillance system.

14. The electronic article surveillance tag according to claim 11, comprising:

state memory for storing state information, a control unit configured to form and store information on a state of said tag in said state memory, and to form said first status message based on said information on the state of said tag maintained in said state memory, a movement sensor for determining a movement state of said tag, the control unit further configured to form said first status message when said movement state indicates that said tag is moving.

15. The electronic article surveillance tag according to claim 11, comprising:

a control unit configured to detect events of status change of said tag, and to store event information on said events of status change of said tag into the memory of said tag, wherein said event information of said events of status change of said tag comprises at least one of the group of: a number of status change events, a time of status change events, and a list of status change events, cause a sending of said event information of said events of status change from said tag to said control sub-system in said first status message for determining a state of said tag based on said event information of said events of status change.

16. The electronic article surveillance tag according to claim 11, wherein said first status message comprises information on tampering of the tag, and said first state is determined based on said information on tampering of the tag.

17. The electronic article surveillance tag according to claim 16, configured to form said information on the tampering of the tag by detecting, by a magnetic field sensor in the tag, a presence of a magnetic field of a predetermined strength, or by detecting by a controller that an electrical connection in an attachment mechanism of the tag is broken.

18. A system for electronic article surveillance, said system comprising at least one processor, a memory including computer program code, the memory and the computer program code configured to, with the at least one processor, cause the system to perform at least the following:

receive a first status message from an electronic article surveillance tag to a control sub-system over a communications connection at a first time instance, said first status message comprising status data of said tag, compute a position of said tag by a positioning sub-system, determine by the control sub-system a first state of said tag based on said status data and said computed position of said tag, determine whether another tag identified to personnel in the electronic article surveillance system is within a predetermined distance of the tag, store said first state in the memory, send a first control message from said control sub-system to said tag, said first control message being formed based on said first state and whether said another tag is within the predetermined distance of said tag, and being configured to cause said tag to alter an operation of said tag based on said first control message.

19. The system according to claim 18, comprising computer program code to cause the system at least to:

detect events of status change by said tag, store event information on said events of status change by said tag into a memory of said tag, wherein said event information of said events of status change comprises at least one of the group of: a number of status change events, a time of status change events, and a list of status change events, send said event information of said events of status change from said tag to said control sub-system in said first status message, determine said first state based on said event information of said events of status change.

20. The system according to claim 18, wherein said first status message comprises information on tampering of the tag, and said first state is determined based on said information on tampering of the tag.

21. The system according to claim 20, configured to cause an alarm if said tampering is detected in an unauthorized area or outside an authorized area based on said computed position of said tag.

22. A computer program product embodied on a non-transitory computer readable medium, comprising computer program code configured to, when executed on at least one processor, cause an apparatus or a system to:

receive a first status message from an electronic article surveillance tag to a control sub-system over a communications connection at a first time instance, said first status message comprising status data of said tag, compute a position of said tag by a positioning sub-system, determine by the control sub-system a first state of said tag based on said status data and said computed position of said tag, determine whether another tag identified to personnel is within a predetermined distance of the tag, store said first state in a memory, send a control message from said control sub-system to said tag, said control message being formed based on said first state and whether said another tag is within the predetermined distance of said tag, for altering an operation of said tag based on said control message.

* * * * *